United States Patent [19]

Hanson et al.

[11] Patent Number: 4,876,434

[45] Date of Patent: Oct. 24, 1989

[54] CURING COATINGS OF A MOISTURE-CURABLE COMPOSITION

[75] Inventors: Raymond Hanson, Rearsby; Malcolm Tillyard, Leicester; Christopher M. Allen, Loughborough, all of United Kingdom

[73] Assignee: British United Shoe Machinery Limited, Leicester, England

[21] Appl. No.: 219,451

[22] Filed: Jul. 15, 1988

Related U.S. Application Data

[62] Division of Ser. No. 859,987, Apr. 9, 1986, Pat. No. 4,780,335.

[30] Foreign Application Priority Data

Sep. 4, 1984 [GB] United Kingdom ..... 8422334

[51] Int. Cl.[4] ..... F27B 9/10; F27B 9/18

[52] U.S. Cl. ..... 219/215; 219/388; 219/400; 12/1 A; 12/17 R

[58] Field of Search ..... 219/215, 388, 400, 401; 12/33.2, 1 A, 1 R, 17 R; 34/105, 236; 198/795

[56] References Cited

U.S. PATENT DOCUMENTS

| | | | |
|---|---|---|---|
| Re. 25,092 | 11/1961 | Cover | 198/795 |
| 1,124,566 | 1/1915 | Wescott | 219/388 |
| 1,705,703 | 3/1929 | Baker | 198/795 |
| 1,850,151 | 3/1932 | Kinney | 34/236 |
| 1,904,580 | 4/1933 | Van Nordstrand | 219/388 |
| 2,491,687 | 12/1949 | Nutt | 219/388 |
| 3,574,952 | 4/1971 | Lee | 34/105 |
| 3,767,032 | 10/1973 | Brückner | 198/795 |
| 4,369,536 | 1/1983 | Hanson | 12/1 A |

FOREIGN PATENT DOCUMENTS

| | | | |
|---|---|---|---|
| 1196591 | 7/1970 | United Kingdom | 12/33.2 |

*Primary Examiner*—Teresa J. Walberg

*Attorney, Agent, or Firm*—Owen J. Meegan; Aubrey C. Brine

[57] ABSTRACT

An apparatus is provided with a chamber (20) into which a plurality of jets of moisture-laden air is directed through apertures (nozzles) 18. Through the chamber lasted shoes S, on the bottoms of which a coating of a moisture-curable adhesive composition has been applied, are progressively moved, supported bottom uppermost. The velocity of the air, which is re-circulated, is between 10 and 20 meters/second (measured at the apertures), its temperature is between 85° C. and 125°0 C. (measured at the point of impingement on the article) and its dew point not greater than 60° C. The lasted shoes are subjected to this treatment for a period of 1 to 3½ minutes.

10 Claims, 3 Drawing Sheets

CURING COATINGS OF A MOISTURE-CURABLE COMPOSITION

Figure 1:
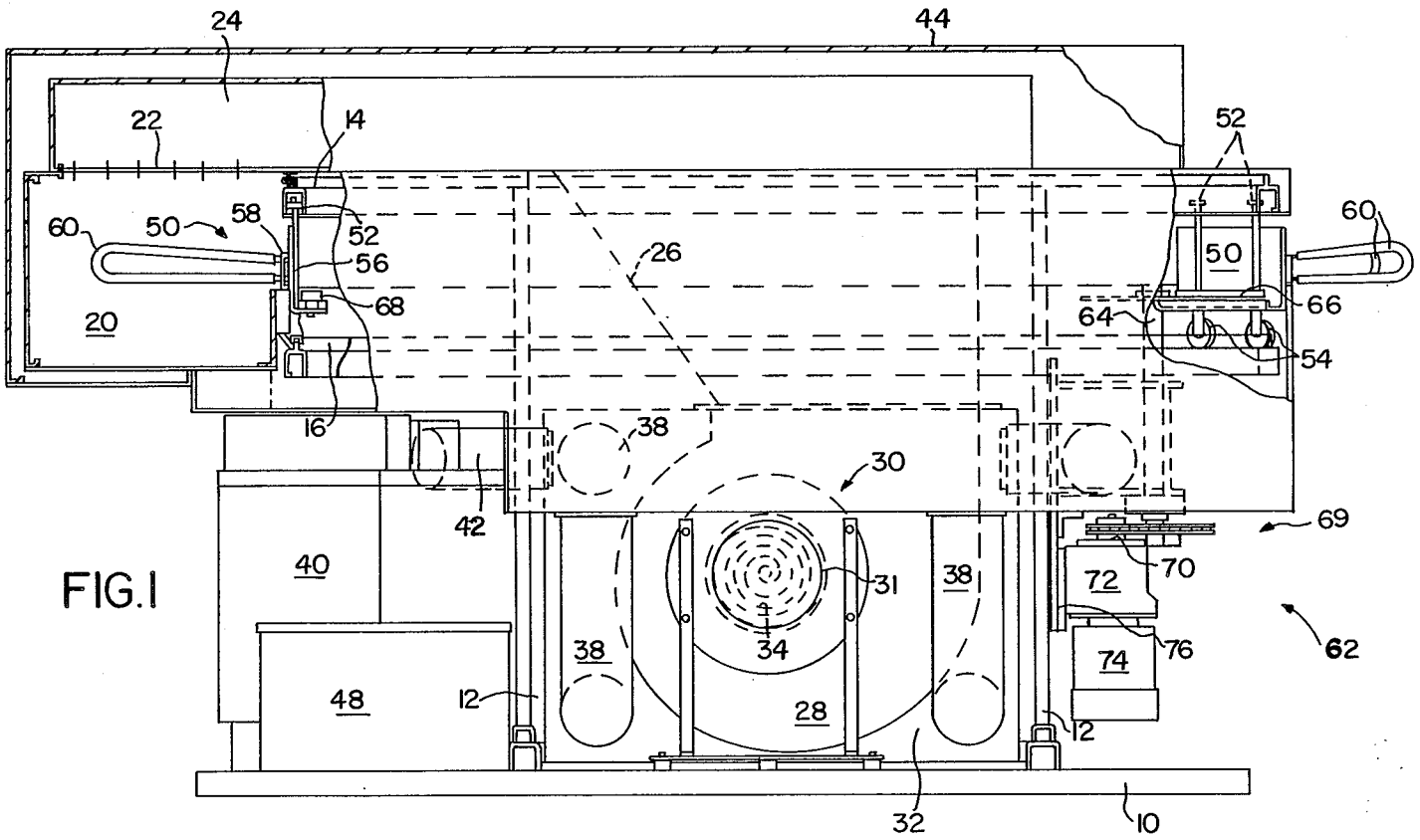

This is a divisional of co-pending application Ser. No. 859 987 filed on 4-9-86 now U.S. Pat. No. 4,780,335.

This invention is concerned with a process whereby a coating of moisture-curable composition applied to the surface of an article is cured and to apparatus for curing such a coating when applied to the bottoms of shoes.

There is described in our co-pending EP-A No. 0079753 (EPC Application No. 82305978.7) a method of treating an article, e.g. a shoe part, having a coating of a moisture curable composition, in carrying out which method the article is placed in an enclosed chamber wherein it is subjected to infra-red radiation and to which chamber a quantity of steam is supplied, the article remaining in the enclosed chamber for a period of between 5 and 25 seconds for the purpose of curing the coating of moisture-curable composition. In addition, in said specification is described an apparatus for use in carrying out the method.

Whereas the method and apparatus described in the aforementioned specification ensures that the coating of composition is speedily and efficiently cured, nevertheless the apparatus does not in itself enhance the possibility of a flow of production, since the loading and unloading of shoes in the chamber, and also the opening and closing of the chamber, is essentially spasmodic.

It is therefore the object of the present invention to provide an improved apparatus for curing a coating of a moisture-curable composition, which apparatus is more suited for incorporation into a continuously operating production line, and also to provide an improved process whereby a coating of a moisture-curable adhesive can be cured, which process is readily adapted for use in a continuous production flow.

There are hereinafter described in detail, to illustrate the invention by way of example, an apparatus for curing a coating of moisture-curable composition applied to the bottoms of shoes, and a process whereby a coating of moisture curable composition applied to the surface of an article is cured. The illustrative apparatus conveniently comprises a chamber, conveyor means by which shoes can be conveyed, bottom uppermost, through the chamber, and means for supplying air to a plenum having an array of apertures extending over substantially the whole of the length of the chamber, said apertures opening into the top of the chamber whereby air supplied therethrough directly impinges on the bottoms of shoes being conveyed by the conveyor means. It will be appreciated that, from a work handling point of view, the most convenient way of conveying the shoes as aforesaid is bottom uppermost, since thereby they can rest with non-coated portions thereof in contact with the supports. However, within the scope of the invention should also be understood conveyor means of more complicated nature by which the shoes can be supported bottom down, in which case the plenum would be situated beneath the conveying means and the apertures would open into the bottom of the chamber.

The air supplying means of the illustrative apparatus supplies air as aforesaid at a velocity of the order of not less than 10 meters/second (measured at the apertures). The effectiveness of air velocity in achieving the desired results has been found not to be significantly enhanced where the air velocity exceeds 20 meters/- second and indeed, from the point of view of efficiency an air velocity not exceeding 15 meters/second is preferred. Furthermore, an air velocity of not less than 13 meters/second is preferred for achieving the desired result in a time which is considered appropriate, as will be hereinafter referred to.

The distance of the apertures from the conveyor means is such that the air impinging on the bottom of a shoe supported by the conveyor means is effective to "scrub" away the layer of air which usually is found to lie static on the surface of the shoe bottom. To achieve this scrubbing action, with air having a velocity as aforementioned it has been found desirable that the shoe bottoms are spaced at a distance of the order of not more than 120 mm from the apertures; it is also desirable to arrange for said distance to be not less than 75 mm, in order to be able to accommodate shoes of different styles and sizes.

The speed at which the conveyor means of the illustrative apparatus operates is variable, thereby varying the time taken for conveying a shoe through the chamber, operator-actuatable means being provided to this end. In general, it has been found to be desirable to provide a facility for varying the time taken for the shoes to be conveyed through the chamber between 1 and 3½ minutes; In using the illustrative apparatus a preferred time has been found to be in the order of 1½ minutes±½ minute. In this way, the amount of heat and moisture by which the coating of moisture-curable composition applied to the shoe bottoms is treated can effectively be varied.

The illustrative apparatus further comprises means for heating the air supplied by the air supplying means to a desired temperature. In general a temperature of not more than 125° C. has been found to be acceptable: furthermore with the type of composition for which the illustrative apparatus is specifically intended the temperature should be not less than 85° C., preferably not less than 90° C. Furthermore for most such compositions a temperature not exceeding 100° C. has been found adequate. The aforementioned temperatures are each as measured at the point at which the air impinges on the shoe bottoms. In some instances it may be desirable to vary the temperature to which the air is heated by the air heating means and to this end temperature varying means is provided in the illustrative apparatus.

The illustrative apparatus further comprises means for supplying a controlled amount of steam whereby the air in the chamber is maintained at a dew point of not more than 60° C., preferably in the range 55° to 60° C.; an optimum dew point is considered to be in the region of 56° C. The steam supplying means of the illustrative apparatus comprises a boiler having an electric heater element and means for controlling the level of water in the boiler in relation to the element, thereby in turn serving to control the amount of steam supplied.

The air supplying means of the illustrative apparatus by which air is supplied to the plenum comprises a fan by which air is drawn over heater means, e.g. electric heater elements, from a collecting chamber into which steam is supplied by the steam supplying means. In addition, air is ducted into the collecting chamber from the first-mentioned chamber, below the level of the conveying means, so that the air within the illustrative apparatus is continuously re-circulated with the constant addition of steam from the steam supplying means. In this way, the energy costs in maintaining the air at the required temperature are significantly reduced, as is also the need for ducting away the exhaust air after the treatment of the shoe bottoms.

In the illustrative apparatus the chamber through which shoes are conveyed by the conveyor means defines a generally U-shaped path for such shoes and to this end the conveyor means comprises an endless track and a plurality of carriages, movable along said track, for supporting shoes bottom uppermost. For moving the carriages driving means is provided which is arranged at a driving locality and by which the carriages are successively engaged as they pass the driving locality, the arrangement being such that the carriage thus engaged is pushed against the carriages preceding it along said track, so that all the carriages are thus advanced along said track. In the illustrative apparatus the drive means comprises a multi-armed rotary drive member which is caused to rotate continuously in the operation of the apparatus, and the arms of which are caused successively to pass through the driving locality and each to engage a carriage thereat.

It will thus be appreciated that by using conveyor means of this type shoes can be conveyed from a loading position through the entry of the chamber, through the latter and out through its exit back to the loading position, so that both loading and unloading of shoes can be effected at a single position, whether by the operator or indeed automatically. In addition, it is convenient to arrange the driving locality for the carriages adjacent to the entry of the exit end of the chamber. In this way the drive means does not interfere in any way with and is not affected by the atmosphere within the chamber.

In the illustrative apparatus each of the carriages of the conveyor means has a pair of projecting support arms, or, more desirably, two pairs of such arms, the or each pair of arms being arranged such that the crown of a shoe last can be received therebetween for supporting the shoe bottom uppermost. Furthermore, the arms are mounted on the carriage for heightwise adjustment thereon; it is expected that such adjustment would be necessary only in the case of a significant change of shoe style or indeed when changing between e.g. men's shoes and ladies'shoes.

The illustrative apparatus is especially useful for carrying out the illustrative process, which is a process whereby a coating of moisture-curable composition applied to the surface of an article is cured. Such articles of course include lasted shoes but the process should not be considered as being limited to the treatment of shoes. The illustrative process comprises supporting the article with the coating exposed and treating the coating with moisture-laden air directed thereat at a predetermined velocity, for a predetermined period and under strict conditions of temperature and moisture control.

With regard to the control of the air being used, the velocity of the air, in carrying out the illustrative process, is in the order of not less than 10 meters/second, preferably not less than 13 meters/second and, from the point of view of effectiveness and efficiency will not exceed 20 meters/second, preferably 15 minutes/-second, as discussed above, with the nozzles through which the air is directed spaced at a distance in the order of not more than 120 mm from the surface to which the coating has been applied so that the air is directed in the form of jets which impinge on the surface of the article, causing local turbulence with the effect that any surface layer of air surrounding the article is broken up, enabling the moisture-laden air being directed on to the article to contact it.

The air is directed thus against the article, in carrying out the illustrative process, for a period not exceeding 3½ minutes, preferably for a period in the order of 1½ minutes ±½ minute. This has been found to be generally sufficient, in combination with other parameters, for ensuring that the moisture-curable composition will cure. It would of course be possible, during this treatment period, to maintain the article in a static condition in relation to the nozzles, but in carrying out the illustrative process the article is moved relative to the nozzles in a direction generally transverse of the jets of moisture-laden air, and indeed the movement of the articles, in carrying the illustrative process, is in a direction extending generally widthwise thereof. In this way it is ensured that the whole of the surface of the article can be treated.

The temperature cf the air, in carrying out the illustrative process, is in the order of not more than 125° C., more particularly 100° C., and in general the temperature should be not less than 85° C., more particularly 90° C. In addition, the dew point of the air is not more than 60° C., preferably 55° to 60° C.; an optimum dew point has been found to be in the region of 56°C.

It will be appreciated that both in respect of the illustrative apparatus and of the illustrative process, various combinations of the foregoing features may be taken. Thus, the invention provides, in one of its several aspects, an apparatus for curing a coating of a moisture-curable composition applied to the bottom of shoes, said apparatus comprising a chamber, conveyor means by which shoes can be conveyed, bottom uppermost, through the chamber, and means for supplying air to a plenum having an array of apertures extending over substantially the whole of the length of the chamber, said apertures opening into the top of the chamber whereby air supplied therethrough directly impinges on the bottoms of shoes being conveyed by the conveyor means, wherein said air supplying means supplies air as aforesaid at a velocity of 10 to 20 meters/second (measured at the apertures), and wherein the apparatus further comprises means for heating the air to a temperature of between 85° C. and 125° C. (measured at the point at which it impinges on the shoe bottoms) and means for supplying a controlled amount of steam whereby the air in the chamber is maintained at a dew point of not greater than 60°C.

In addition, the invention also provides, in another of its various aspects, a process whereby a coating of moisture-curable composition applied to the surface of an article is cured, said process comprising supporting the article with the coating exposed, and directing at said coating, for a period of between 1½ and 3½ minutes, a plurality of jets of moisture-laden air from nozzles spaced at between 75 and 120 mms from the surface to which the coating has been applied, wherein the velocity of the air is between 10 and 20 meters/second, its temperature is between 85° C. and 125° C., and its dew point is not greater than 60°C.

There now follows a detailed description, to be read with reference to the accompanying drawings, of the illustrative apparatus and the illustrative process, from which description the various objects and aspects of the present invention will be made apparent. It will of course be appreciated that the illustrative apparatus and the illustrative process have been selected for description merely by way of non-limiting example.

Figure 2:
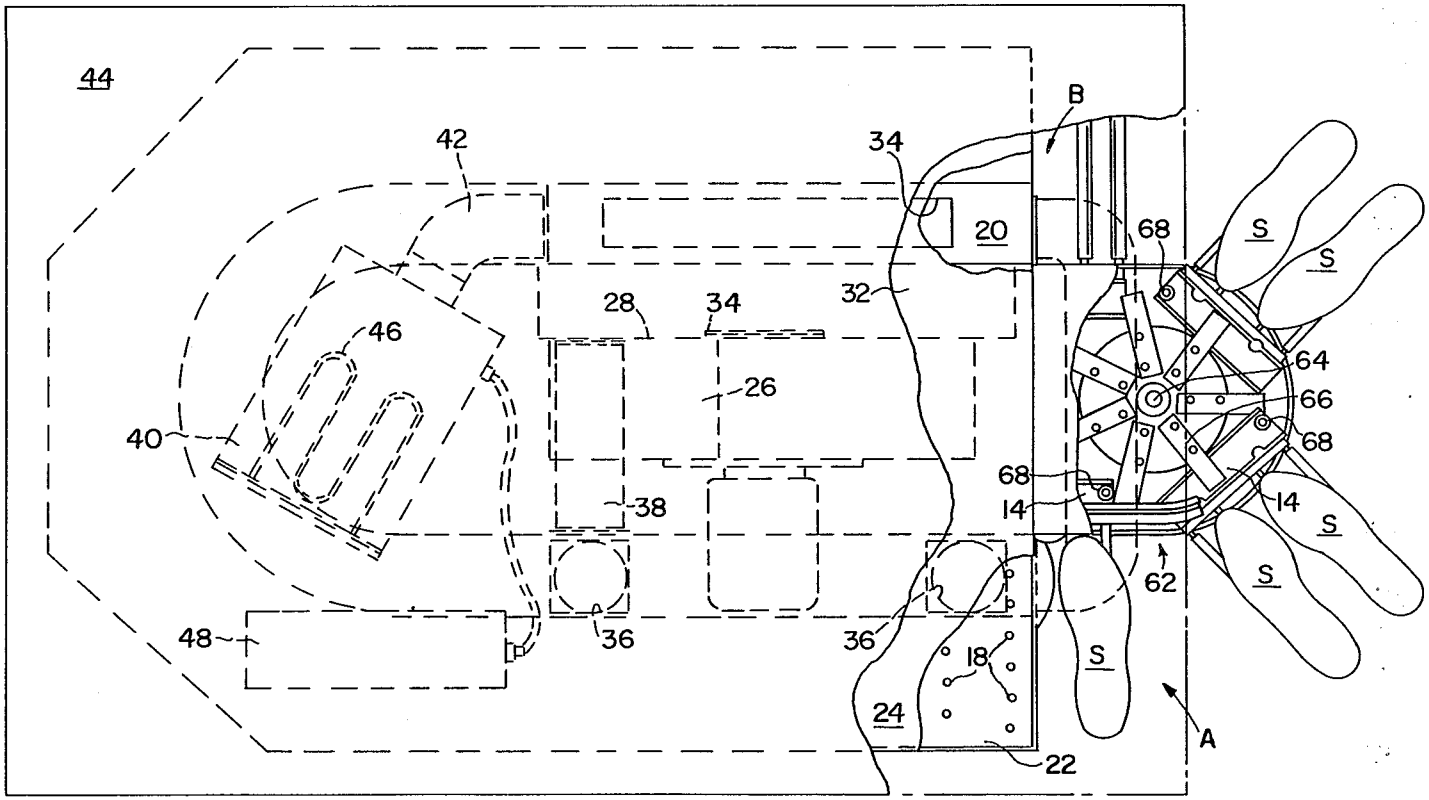
Figure 3:
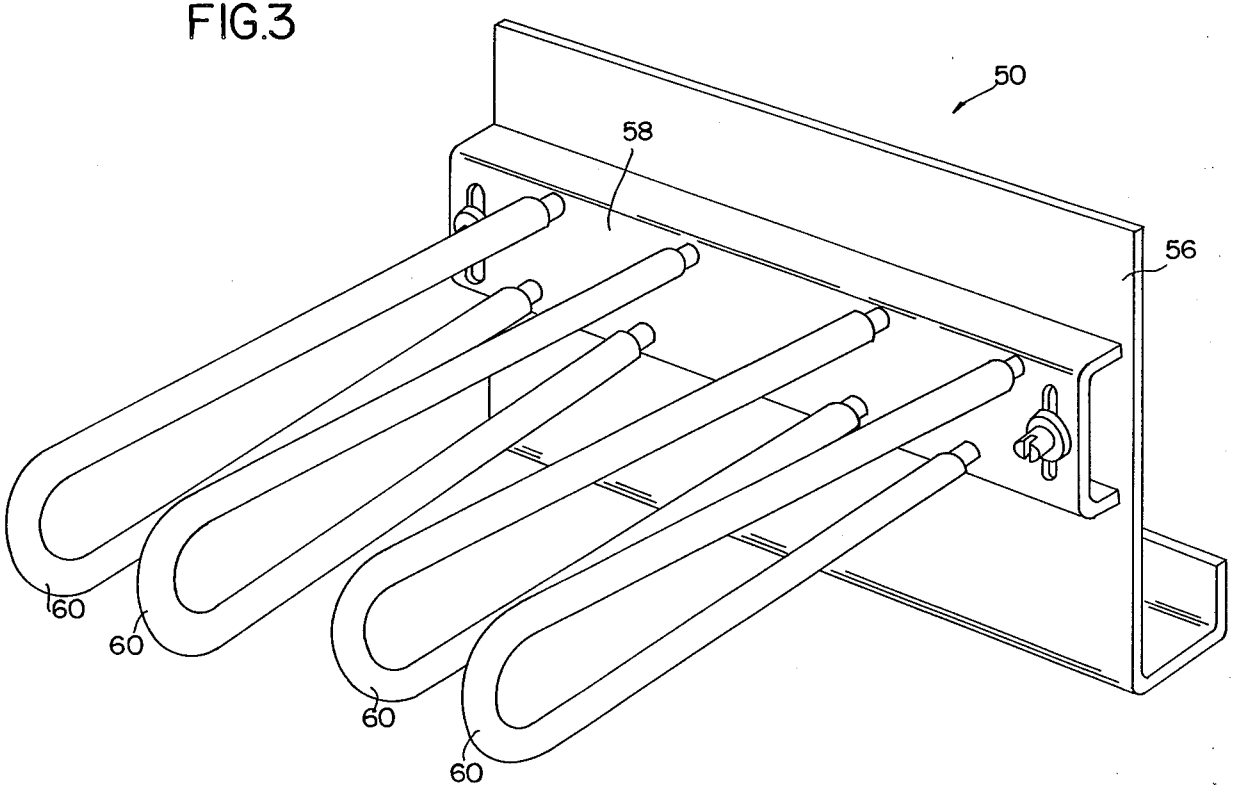

In the accompanying drawings:

FIGS. 1 and 2 are respectively plan and side views of the illustrative apparatus; and FIG. 3 is a fragmentary view of a carriage forming part of conveyor means of the illustrative apparatus.

With reference to FIGS. 1 and 2, the illustrative apparatus comprises a base 10 having upstanding support members 12 on which upper and lower track members 14,16 are mounted, one above the other, defining an endless ovalshaped track, as will be referred to hereinafter. Surrounding the track is a chamber 20 which is closed at the top by a perforated lid 22 which also forms the floor of a plenum chamber 24 arranged above the track 14,16 and chamber 20. The lid 22 is perforated in a regular manner to provide an array (in the form of a plurality of rows) of apertures 18, each row extending radially of the oval track. Beneath the track 14,16, centrally disposed within the oval shape thereof, is a ducting 26 which opens into the plenum chamber 24 at its top and at its bottom is connected to a housing 28 for a fan generally designated 30. The fan is driven by a suitable electric motor 31 sufficient to provide an air velocity of at least 12 meter/second measured at the apertures 18 in the perforated lid 22. The fan draws air from a collecting chamber 32 and during such drawing the air passes over a series of electric heater coils 34 arranged adjacent to the fan inlet. The floor of the chamber 20 has an elongated opening 34, extending beneath one side portion of the oval track 14,16 and this opening 34 opens into the top of the collecting chamber 32. A plurality of holes 36 is also provided in the floor of the chamber 20, beneath the other side of the track 14,16, which holes 36 are connected by ducting 38 to the collecting chamber 32. In this way air can be uniformly exhausted from the chamber 20 to the collecting chamber 32. In addition, a boiler 40 is provided which is connected by ducting 42 to the collecting chamber 32 for supplying steam, and thus moisture, to the air in the collecting chamber 32. It will thus be observed that under the action of the fan 30 air is continuously re-circulated through the chamber 20 and during such re-circulation is heated by the heater elements 34 and laden with moisture by the boiler 40.

For conserving heat, the walls of the plenum chamber 24 and of the chamber 20, collecting chamber 32 and fan housing 28 are all lagged. In addition, an outer cover 44 is provided, which enhances appearance as well as assisting insulation. Furthermore, in order to ensure that there is no excessive heat loss at the side of the chamber 20 opposite the opening 34, a yieldable wall member (not shown) in the form of a plurality of sets of bristles is provided, extending from the floor of the chamber up to just beneath the conveyor means. Using bristles, this member does not impede the passages of e.g. high-legged boots passing through the chamber 20.

The temperature of the air in the chamber 20 is regulated in any desired manner, as will be hereinafter referred to, and in addition the rate of supply of steam from the boiler 40 is controlled. In the latter case, to ensure a constant supply of steam, the control takes the form of controlling the level of the water in the boiler in relation to an electric heater element 46, thereby regulating the amount of steam produced. In order thus to control the level of the water a topping up tank 48 is provided. For temperature control, furthermore, means is provided in a form of a variable thermostat (not shown) by which the operator can vary the temperature to which the air is heated by the heater elements 34, according to the required parameters, as will be referred to hereinafter.

The chamber 20 of the illustrative apparatus is generally U-shaped, having entry and exit openings indicated by arrows A,B from which project one end of the track 14,16. In the illustrative apparatus the opening 34 is arranged at said one side of the chamber 20 leading to the exit opening and the holes 36 are arranged at said other side adjacent the entry opening.

The track 14,16 forms part of conveying means of the illustrative apparatus and serves to support a plurality of carriages generally designated 50, each of which is supported by upper and lower wheels 52, 54 running respectively on the upper and lower tracks 14,16. Each carriage 50 comprises an angled plate 56 on which the rolls 52, 54 are supported, the plate having secured thereto an angle member 58 on which two pairs of support arms 60 are secured, the arms 60 (as can be seen in FIG. 3) projecting outwardly from the angle member 58 and thus radially and outwardly from the track 14,16 into the chamber 20. The angle member 58 is mounted for heightwise adjusting movement on the plate 56 by pin-and-slot connections (see FIG. 3). Each pair of support arms 60 is arranged to receive between the arms the crown (or cone) of the last of a lasted shoe such that the shoe is supported by the arms bottom uppermost, i.e. with the shoe bottom facing the apertures 18 opening into the chamber 20. The arms are spaced from the apertures 18 by a distance of between 75 and 120 mm; ideally the bottoms of shoes supported by the arms 60 should be spaced from the apertures by a distance of some 55 mm.

For moving the carriages 50 along the track 14,16, drive means generally designated 62 is provided comprising a drive shaft 64 on which a plurality of (in casu seven) arms 66 which are movable in a horizontal plane. As the shaft 64 rotates, therefore, carrying the arm 66 therewith, rolls 68 on the carriages 50 in the vicinity of the entry/exit end of the conveyor means can be engaged by one of said arms, thereby serving to advance that carriage 50 along the track 14,16. Each carriage 50, furthermore, is arranged to move the carriage preceding it along the track 14,16 by pushing thereagainst so that by the action of the drive means 62, the carriages are advanced along the track. For causing the rotation of the shaft 64, the drive means 62 further comprises a chain-and sprocket drive generally designated 69 which connects the shaft 64 with an output drive shaft 70 of a gearbox 72 driven by an electric motor 74, the gearbox and motor being mounted on a support plate 76 carried by the forward support members 12 of the illustrative apparatus. The motor 74 operates continuously in the operation of the illustrative apparatus, so that the carriages 50 are moved continuously, or substantially continuously along the track 14,16.

Whereas the illustrative apparatus described above is provided with support arms 60 by which shoes can be supported bottom uppermost, in other apparatus in accordance with the invention otherwise generally similar to the illustrative apparatus the conveyor means may be adapted to support shoe soles on a surface of which a coating of a moisture-curable composition has been applied, and the scope of the present invention should also be read as embracing the treatment of shoe soles mutatis mutandis; thus where appropriate, reference to supporting the articles "bottom uppermost"

should be understood as indicating "coated surface uppermost".

In using the illustrative apparatus in carrying out the illustrative process, shoes S are mounted, if desired in pairs, on the carriages at a loading station adjacent to the entry end A of the chamber 20, as the carriages are progressively moved through the chamber. The shoes are of course supported bottom uppermost on the support arms 60, that is with the shoe bottoms facing the apertures 18 in the lid 22 of the chamber 20. The parameters required for the illustrative process are that the air should be impelled towards the surface of the shoe bottom at a velocity of between 10 and 20 meters/-second (as measured at the apertures 18) and impinge thereon and the temperature of the air should be between 85° C. and 125° C., preferably between 90° C. and 100° C. with an optimum temperature in most cases of 95° C. Furthermore, the air should be moisture-laden such that its dew point is not greater than 60° C., preferably between 55° and 60° C.

The shoes are of course continuously moved along the chamber 20 so that they are moved relative to the apertures (or nozzles) 18 and thus successively passed the jets of moisture-laden air. The manner in which the shoes are supported by the carriages 50, ensures that the shoes are moved in a direction extending widthwise of their bottoms past successive rows of apertures 18 extending radially about the oval-shaped track 14,16. In this way the shoe bottom is successively "swept" by the jets of moisture-laden air.

The speed of the conveyor means (and ultimately the output speed of the motor 74) is so set that the shoes are moved through the whole of the chamber 20 in a period of between 1 and 3½ minutes; an optimum period is considered ±½ minute.

It has been found that with these ranges parameters, moisture-curable composition coatings on shoe bottoms can be readily cured within the time set, without subjecting the shoes themselves to damage caused by excessive heating or indeed water damage. Furthermore, because of the continuous operation of the conveyor means, and the continuous track passing through the U-shaped chamber 20, the work handling of the shoes to be treated is rendered convenient for one operator to perform, with consequent improvement in productivity and efficiency.

EXAMPLE

In carrying out one example of a process in accordance with the invention a layer, 0.01 mm thick, of Bostik Supergrip 9801 adhesive composition was applied to the bottom of each of a plurality of lasted shoes for the subsequent attachment thereto of sole units. ("Bostik" is a Registered Trade Mark in respect of, inter alia, adhesive compositions.) This composition, which is available from Bostik Ltd, Ulverscroft Road, Leicester, is a moisture-curable composition of the polyurethane prepolymer type, and has a viscosity of 22 Newtons meters$^2$ at its application temperature of 100° C.; this enables it to be applied in relatively thin layers, especially when a nozzle of the type described and claimed in GB-A 2098884 is used.

In addition to each shoe bottom, each sole unit also had a coating of the same composition applied thereto in a similar thickness. In the case of the sole units, curing of the adhesive composition may, if desired, take place in atmosphere; the cure time is then between 8 and 72 hours, depending upon film thickness, porosity of the substrate and the relative humidity of the atmosphere. This enables the sole units to be coated before being brought to the production line.

The coated shoe bottoms were, following application, immediately placed on the support arms 60 of illustrative apparatus at the load/unload station, and were carried through the chamber 20, as above described. The apparatus was set up with the following parameters:

Air velocity —14 meters/second (measured at the nozzles)

Air temperature —95° C.

Air dewpoint —56° C.

Conveyor speed —timed to carry shoes through the chamber in 1½ minutes.

It was found that, using the illustrative apparatus set up as aforesaid, the adhesive coating was substantially completely cured within the time stated.

The coated shoes were then transferred to the next operation, which was sole attaching. In this operation activation of the coating on the sole unit and, if necessary, the coating on the shoe bottom also, took place using an activator of the type described in EP-A 0092320, whereafter the sole unit was bonded to the shoe bottom using a conventional sole attaching press.

We claim:

1. Apparatus for curing a coating of a moisture-curable composition applied to the bottoms of shoes comprising:

a chamber;

a substantially enclosed plenum overlying said chamber and having a bottom wall common with the top wall of said chamber;

conveyor means by which shoes are conveyed, bottom uppermost through said chamber;

means for supplying a continuous stream of air to said plenum, said bottom wall having an array of apertures extending over substantially the whole length of said chamber and opening into the top of said chamber whereby air supplied therethrough directly impinges on the bottom of a shoe being conveyed by said conveyor means through said chamber;

said apertures further comprising means for heating the air; and means for supplying a controlled amount of steam to the air, prior to entry of the air into said plenum said conveyor means comprising an endless track and a plurality of carriages, movable along said track, for supporting shoes bottom uppermost, each said carriage having a pair of projecting support means between which the crown of a shoe last can be received for supporting the shoe bottom uppermost, said support means being mounted on said carriage for height-wise adjustment thereon.

2. Apparatus according to claim 1 wherein said chamber defines a generally U-shaped path along which shoes are conveyed by said conveyor means.

3. Apparatus according to claim 1 which further includes a collecting chamber disposed in the air steam and wherein said air supplying means comprises a fan by which air is drawn past said air heater means from said collecting chamber into which steam is supplied by said stream supplying means.

4. Apparatus according to claim 3 wherein air is ducted from said chamber below the level of said conveying means into said collecting chamber.

5. Apparatus according to claim 1 wherein means is provided for varying the temperature to which the air is heated by said air heating means.

6. Apparatus according to claim 1 wherein means is provided for varying the time taken for conveying a shoe through said chamber.

7. Apparatus according to claim 1 wherein said steam supplying means comprises a boiler having an electric heater element and means for controlling the level of water in said boiler in relation to said element.

8. Apparatus according to claim 1 wherein said endless track runs through said U-shaped chamber and through a loading/unloading station arranged at the open end of the U-shaped.

9. Apparatus according to claim 1 wherein drive means is provided which is arranged at a driving locality and by which said carriages are successively engaged as they pass the driving locality, the arrangement being such that each said carriage thus engaged is pushed against said carriages preceding it along said track, thus advancing all said carriages therealong.

10. Apparatus according to claim 9 wherein said drive means comprises a multi-armed rotary drive member which is caused to rotate continuously in the operation of said apparatus, and said arms of which are caused successively to pass through the driving locality and each to engage a said carriage thereat.

* * * * *